US009777414B2

(12) United States Patent
Okuda et al.

(10) Patent No.: US 9,777,414 B2
(45) Date of Patent: Oct. 3, 2017

(54) BULKINESS RECOVERY APPARATUS FOR NONWOVEN FABRIC

(71) Applicant: UNICHARM Corporation, Ehime (JP)

(72) Inventors: Jun Okuda, Kagawa (JP); Satoshi Mitsuno, Kagawa (JP)

(73) Assignee: UNICHARM CORPORATION, Ehime (JP)

( * ) Notice: Subject to any disclaimer, the term of this patent is extended or adjusted under 35 U.S.C. 154(b) by 0 days.

(21) Appl. No.: 15/028,933

(22) PCT Filed: Sep. 25, 2014

(86) PCT No.: PCT/JP2014/075487
§ 371 (c)(1),
(2) Date: Apr. 12, 2016

(87) PCT Pub. No.: WO2015/056544
PCT Pub. Date: Apr. 23, 2015

(65) Prior Publication Data

US 2016/0258090 A1 Sep. 8, 2016

(30) Foreign Application Priority Data

Oct. 18, 2013 (JP) ..... 2013-217209

(51) Int. Cl.
*F26B 21/06* (2006.01)
*D04H 1/492* (2012.01)
(Continued)

(52) U.S. Cl.
CPC ..... *D04H 1/492* (2013.01); *D04H 1/50* (2013.01); *D04H 1/54* (2013.01); *D06C 7/00* (2013.01)

(58) Field of Classification Search
CPC ..... F26B 21/00; F26B 21/06; D04H 1/492; D04H 1/50; D04H 1/54; D06C 7/00
(Continued)

(56) References Cited

U.S. PATENT DOCUMENTS 5,657,555 A * 8/1997 Milojevic ..... F26B 3/283 34/271
5,682,190 A * 10/1997 Hirosawa ..... B41J 2/14145 347/42
(Continued)

FOREIGN PATENT DOCUMENTS

CN 1226675 A 8/1999
CN 1497086 A 5/2004
(Continued)

OTHER PUBLICATIONS

Written Opinion of the ISA in PCT/JP2014/075487, mailed Dec. 22, 2014.
(Continued)

*Primary Examiner* — Stephen M Gravini
(74) *Attorney, Agent, or Firm* — Hauptman Ham, LLP

(57) ABSTRACT

A bulkiness recovery apparatus for nonwoven fabric includes a hot-air source; and a case unit including a base member, and first and second members. The first and second members face opposite first and second surfaces of the base member and partition first and second conveyor spaces. The base member has first and second hot-air chambers. The first and second surfaces have first and second jet inlets. The first and second hot-air chambers at least partly overlap in a direction normal to the first surface. First and second conveying directions of the nonwoven fabric in the first and second conveyor spaces are different. Hot air flows along the first conveying direction and is blasted from the first jet inlet into the first conveyor space. Hot air flows along the second
(Continued)

conveying direction and is blasted from the second jet inlet into the second conveyor space.

8 Claims, 7 Drawing Sheets

(51) Int. Cl.
*D04H 1/54* (2012.01)
*D04H 1/50* (2012.01)
*D06C 7/00* (2006.01)

(58) Field of Classification Search
USPC ..... 34/620
See application file for complete search history.

(56) References Cited

U.S. PATENT DOCUMENTS 5,901,462 A * 5/1999 Rudd ..... F26B 13/14 34/122
5,974,691 A * 11/1999 Marchal ..... D21F 5/20 34/122
6,006,446 A * 12/1999 Pagendarm ..... F26B 13/104 34/633
6,463,674 B1 * 10/2002 Meyers ..... B41J 11/002 34/304
7,918,040 B2 * 4/2011 Lenoir ..... D21F 5/00 162/359.1
7,926,200 B2 * 4/2011 Lenoir ..... F26B 3/305 162/111
8,011,115 B2 * 9/2011 Komulainen ..... D21F 5/042 131/365
8,806,771 B2 * 8/2014 Holmes ..... B29B 13/065 219/388
8,910,396 B1 * 12/2014 Burchell ..... F26B 15/18 198/836.3
9,500,408 B2 * 11/2016 Spangler ..... F26B 15/122
2002/0152630 A1 * 10/2002 Lindsay ..... D21F 5/004 34/111
2004/0237591 A1 * 12/2004 Shetterly ..... C03B 29/08 65/111
2006/0185525 A1 * 8/2006 Kuenen ..... A21B 1/26 99/386
2016/0258090 A1 * 9/2016 Okuda ..... D04H 1/54

FOREIGN PATENT DOCUMENTS

CN 201245771 Y 5/2009
CN 101654853 A 2/2010
CN 102227528 A 10/2011
JP 2004-137655 A 5/2004
JP 2009-155756 A 7/2009
JP 5102610 B2 12/2012
JP WO 2015056544 A1 * 4/2015 ..... D04H 1/54
JP 5728556 B2 * 6/2015 ..... D04H 1/54
WO 2010/047292 A1 4/2010
WO 2013/157611 A1 10/2013

OTHER PUBLICATIONS

International Search Report in PCT/JP2014/075487, mailed Dec. 22, 2014.

* cited by examiner

BULKINESS RECOVERY APPARATUS FOR NONWOVEN FABRIC

RELATED APPLICATIONS

The present application is a National Phase entry of International Application No. PCT/JP2014/075487, filed Sep. 25, 2014, which claims priority of Japanese Application No. 2013-217209, filed Oct. 18, 2013.

TECHNICAL FIELD

The invention relates to a bulkiness recovery apparatus for nonwoven fabric.

BACKGROUND ART

Generally, nonwoven fabric, after manufacturing, is wound in rolls to be stored in a form of a web roll of nonwoven fabric. Thereafter, in another process, the nonwoven fabric is fed out from the web roll and used. At the time of winding the nonwoven fabric, the nonwoven fabric is subject to tension. Consequently, the nonwoven fabric which has been wound is compressed in the thickness direction and its bulkiness decreases. For this reason, the method being for recovering bulkiness of the nonwoven fabric has been proposed in which hot air is blown to the surface of nonwoven fabric in the a direction normal to the surface to heat the nonwoven fabric (see [Patent Literature 1], for example).

CITATION LIST

Patent Literature

[Patent Literature 1] Japanese Unexamined Patent Application Publication No. 2004-137655

SUMMARY OF INVENTION

Technical Problem

However, in the method of [Patent Literature 1], hot air is blown in the opposite direction to the direction in which the bulkiness of nonwoven fabric recovers. This may lower an effect in bulkiness recovery by heating nonwoven fabric. As described in [Patent Literature 1], hot air is blown to nonwoven fabric which is being conveyed by a conveyor belt extending in a direction in which the nonwoven fabric continues, or hot air is blown to the nonwoven fabric which is being conveyed while winding the nonwoven fabric on the circumferential surface of a drum. In these cases, in order to ensure a heat time necessary to recover the bulkiness of nonwoven fabric, there has been a problem that an apparatus is required to be upsized.

The invention has been made in view of the above conventional problems, and an advantage thereof is to provide a bulkiness recovery apparatus for nonwoven fabric capable of being downsized and preventing decrease of bulkiness recovery effect, which is achieved by heating of nonwoven fabric.

Solution to Problem

An aspect of the invention to achieve the above advantage is a bulkiness recovery apparatus for nonwoven fabric, the apparatus being for recovering bulkiness of the nonwoven fabric by blowing hot air to heat the nonwoven fabric, the apparatus including: a hot-air source; and a case unit including a base member, a first member and a second member, the first member being provided facing a first surface of the base member and partitioning a first conveyor space for the nonwoven fabric, the second member being provided facing a second surface of the base member and partitioning a second conveyor space for the nonwoven fabric, the base member having a first hot-air chamber and a second hot-air chamber formed inside the base member, the first surface having a first jet inlet, the second surface being placed on a side opposite the first surface, the second surface having a second jet inlet, the first hot-air chamber being supplied with hot air from the hot-air source and communicating with the first jet inlet, the second hot-air chamber being supplied with hot air from the hot-air source and communicating with the second jet inlet, the first hot-air chamber and the second hot-air chamber being arranged so as to at least partly overlap in a direction normal to the first surface, a conveying direction in which the nonwoven fabric is conveyed inside the first conveyor space being different from the conveying direction in the second conveyor space, hot air being blasted from the first jet inlet into the first conveyor space, the hot air flowing along the conveying direction from a one side toward another side in the conveying direction inside the first conveyor space, hot air being blasted from the second jet inlet into the second conveyor space, the hot air flowing along the conveying direction from the other side toward the one side in the conveying direction inside the second conveyor space.

Other features of this invention will become apparent from the description in this specification and the attached drawings.

Advantageous Effects of Invention

According to the invention, it is possible to provide a bulkiness recovery apparatus for nonwoven fabric capable of being downsized and preventing decrease of bulkiness recovery effect, which is achieved by heating of nonwoven fabric.

DESCRIPTION OF EMBODIMENTS

Figure 1A:
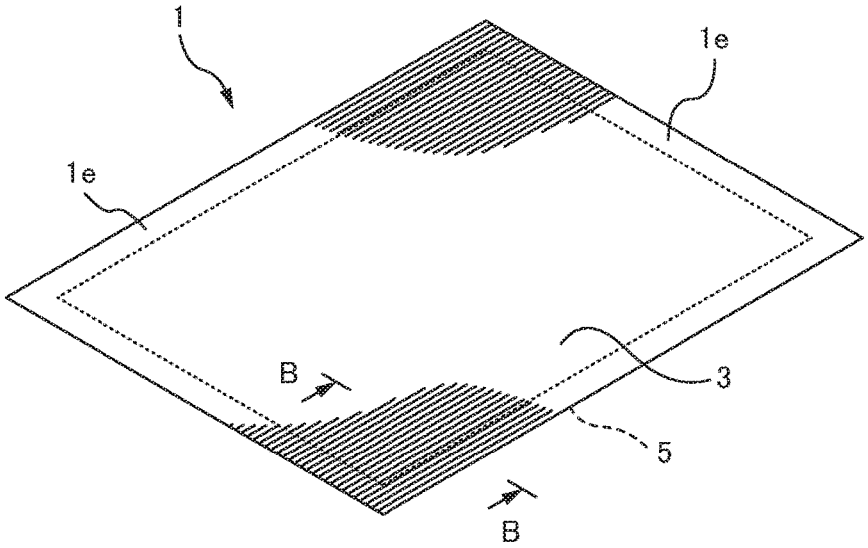
FIG. 1A is a perspective view of a pet pad.

At least the following matters will become apparent from the descriptions in the specification and the accompanying drawings.

A bulkiness recovery apparatus for nonwoven fabric, the apparatus being for recovering bulkiness of the nonwoven fabric by blowing hot air to heat the nonwoven fabric, the apparatus including: a hot-air source; and a case unit including a base member, a first member and a second member, the first member being provided facing a first surface of the base member and partitioning a first conveyor space for the nonwoven fabric, the second member being provided facing a second surface of the base member and partitioning a second conveyor space for the nonwoven fabric, the base member having a first hot-air chamber and a second hot-air chamber formed inside the base member, the first surface having a first jet inlet, the second surface being placed on a side opposite the first surface, the second surface having a second jet inlet, the first hot-air chamber being supplied with hot air from the hot-air source and communicating with the first jet inlet, the second hot-air chamber being supplied with hot air from the hot-air source and communicating with the second jet inlet, the first hot-air chamber and the second hot-air chamber being arranged so as to at least partly overlap in a direction normal to the first surface, a conveying direction in which the nonwoven fabric is conveyed inside the first conveyor space being different from the conveying direction in the second conveyor space, hot air being blasted from the first jet inlet into the first conveyor space, the hot air flowing along the conveying direction from a one side toward another side in the conveying direction inside the first conveyor space, hot air being blasted from the second jet inlet into the second conveyor space, the hot air flowing along the conveying direction from the other side toward the one side in the conveying direction inside the second conveyor space.

With such a bulkiness recovery apparatus for nonwoven fabric, since hot air flows along the conveying direction of nonwoven fabric, it is possible to prevent decrease of bulkiness recovery effect of the nonwoven fabric (if hot air is blown to a surface of nonwoven fabric in the direction normal to the surface, the effect will decrease). Further, for example, compared to a case in which the first hot-air chamber and the second hot-air chamber are arranged in the direction normal to the first surface so as not to overlap, it is possible to reduce the length of the base member (the distance between the first surface and the second surface) in the direction normal to the first surface. Consequently, it is possible to downsize the bulkiness recovery apparatus in the direction normal to the first surface.

In such a bulkiness recovery apparatus for nonwoven fabric, a part of a pole that supports the case unit is placed inside the base member.

With such a bulkiness recovery apparatus for nonwoven fabric, a part of the pole can be placed inside a space necessary to form the hot-air chambers. This makes it possible to downsize the bulkiness recovery apparatus in the direction normal to the first surface, compared to a case, for example, in which the pole is placed outside the base member.

In such a bulkiness recovery apparatus for nonwoven fabric, a first evacuation opening is formed in the first surface, hot air is blasted from the first jet inlet, flows along the conveying direction, and is evacuated through the first evacuation opening from the first conveyor space, a second evacuation opening is formed in the second surface, hot air is blasted from the second jet inlet, flows along the conveying direction, and is evacuated through the second evacuation opening from the second conveyor space, a first evacuation chamber and a second evacuation chamber are formed inside the base member, the first evacuation chamber communicates with the first evacuation opening, the second evacuation chamber communicates with the second evacuation opening, the first evacuation chamber, the second evacuation chamber, the first hot-air chamber, and the second hot-air chamber are placed so as to at least partly overlap in the direction normal to the first surface.

With such a bulkiness recovery apparatus for nonwoven fabric, it is possible to reduce the length of the base member (the distance between the first surface and the second surface) in the direction normal to the first surface, compared to cases, for example, in which the first evacuation chamber and the second evacuation chamber are placed in the direction normal to the first surface so as not to overlap, or in which the evacuation chamber and the hot-air chamber are placed so as not to overlap. Consequently, it is possible to downsize the bulkiness recovery apparatus in the direction normal to the first surface.

In such a bulkiness recovery apparatus for nonwoven fabric, on the one side inside the base member in the conveying direction, the second evacuation chamber is placed outside on the one side with respect to the first hot-air chamber, and on the other side inside the base member in the conveying direction, the first evacuation chamber is placed outside on the other side with respect to the second hot-air chamber.

With such a bulkiness recovery apparatus for nonwoven fabric, the distance one surface of nonwoven fabric will travel being exposed to hot air inside the conveyor space of the case unit is not excessively long. That is, it is possible to prevent overheating the nonwoven fabric. This makes it possible to prevent the nonwoven fabric from having a tendency to be curved when the nonwoven fabric is wound around the conveying roller outside the case unit, for example. In addition, this makes it possible to prevent the variation in the width of the nonwoven fabric due to softening and decrease of bulkiness recovery effect.

In such a bulkiness recovery apparatus for nonwoven fabric, on the one side inside the base member in the conveying direction, the first hot-air chamber is placed outside on the one side with respect to the second evacuation chamber, and on the other side inside the base member in the conveying direction, the second hot-air chamber is placed outside on the other side with respect to the first evacuation chamber.

With such a bulkiness recovery apparatus for nonwoven fabric, the distance one surface of nonwoven fabric will travel being exposed to hot air inside the conveyor space of the case unit becomes longer. This makes it possible to more reliably heat the nonwoven fabric to recover its bulkiness. In other words, it is possible to reduce the length of the case unit in the conveying direction while ensuring the distance for heating and conveying nonwoven fabric. Consequently, it is possible to downsize the bulkiness recovery apparatus in the conveying direction.

In such a bulkiness recovery apparatus for nonwoven fabric, a duct that evacuates hot air from the case unit is connected to one surface of surfaces partitioning the first evacuation chamber, the surface being a side surface in a width direction of the nonwoven fabric and intersecting the conveying direction, and the duct is also connected to one surface of surfaces partitioning the second evacuation chamber, the surface being a side surface in the width direction.

With such a bulkiness recovery apparatus for nonwoven fabric, it is possible to downsize the bulkiness recovery apparatus in the conveying direction, compared to a case, for example, in which the duct is connected to one surface of surfaces partitioning the evacuation chamber, the surface being an end surface on an outer end in the conveying direction.

In such a bulkiness recovery apparatus for nonwoven fabric, a duct that supplies hot air from the hot-air source is connected to one surface of surfaces partitioning the first hot-air chamber, the surface being a side surface in a width direction of the nonwoven fabric and intersecting the conveying direction, and the duct is also connected to one surface of surfaces partitioning the second hot-air chamber, the surface being a side surface in the width direction.

With such a bulkiness recovery apparatus for nonwoven fabric, it is possible to downsize the bulkiness recovery apparatus in the conveying direction, compared to a case, for example, in which the duct is connected to one surface of surfaces partitioning the evacuation chamber, the surface being an end surface on an outer end in the conveying direction.

In such a bulkiness recovery apparatus for nonwoven fabric, a plurality of the case units are aligned in a direction intersecting the first surface.

With such a bulkiness recovery apparatus for nonwoven fabric, a plurality of case units each of which includes a base member having a shorter length in the direction normal to the first surface are used. This makes it possible to further downsize the bulkiness recovery apparatus in the direction normal to the first surface.

—Pet Pad 1—

Figure 1B:
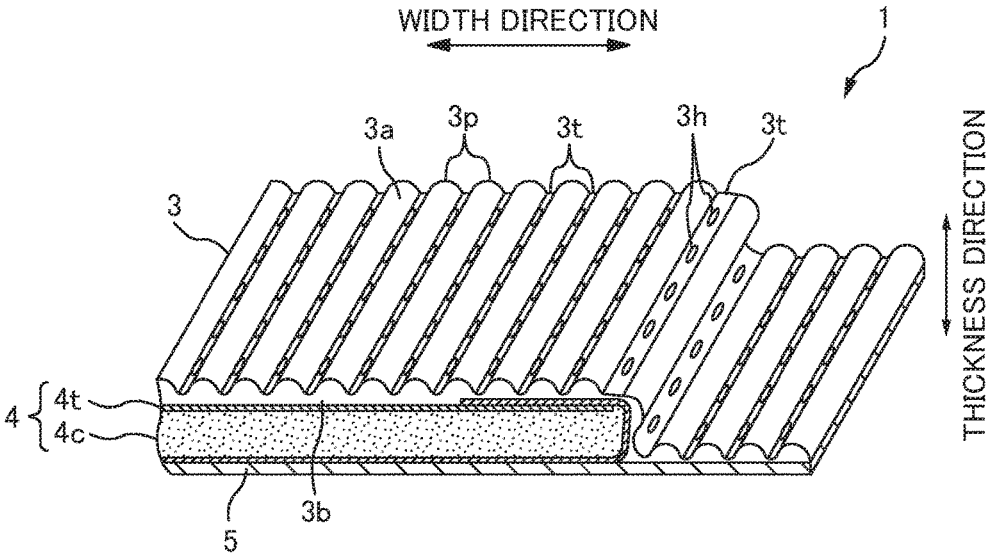
FIG. 1B is a cross sectional view of the pet pad taken along line B-B in FIG. 1A.

FIG. 1A is a perspective view of a pet pad 1, and FIG. 1B is a cross sectional view of the pet pad 1 taken along line B-B in FIG. 1A. Nonwoven fabric the bulkiness of which has been recovered by a bulkiness recovery apparatus for nonwoven fabric according to the invention (to be described later) is used as a top sheet 3 of the pet pad 1 and the like. The pet pad 1 is placed on a floor or the like to be used for disposing of animal excrement, and includes: a liquid-permeable top sheet 3 having a rectangular shape when viewed from above; a liquid-impermeable back sheet 5 having substantially the same shape as the top sheet 3; and a liquid-absorbent absorbent body 4 placed between the sheets 3 and 5, for example. The top sheet 3, the absorbent body 4 and the back sheet 5 are joined to one another with hot-melt adhesive, etc. In the edge 1*e* of the pet pad 1 in which the absorbent body 4 does not exist, the top sheet 3 and the back sheet 5 are joined with hot-melt adhesive, etc.

The absorbent body 4 is, for example, a thing made by covering an absorbent core 4*c* with a liquid-permeable cover sheet 4*t* (e.g. tissue paper), the absorbent core 4*c* being made by applying super absorbent polymer (so-called SAP) to liquid absorbent fiber (e.g. pulp fiber). And the back sheet 5 is, for example, film made of material such as polyethylene (PE), polypropylene (PP), polyethylene terephthalate (PET), or the like.

As an example of the top sheet 3, a nonwoven fabric 3 is used, as shown in FIG. 1B, whose one surface 3*a* (hereinafter referred to as a top face) has straight grooves 3*t* and straight protrusions 3*p* arranged alternatively in the width direction thereon and whose other surface 3*b* (hereinafter referred to as a back face) is substantially flat. Such a nonwoven fabric 3 can be made by a well-known process of blowing air (see Japanese Unexamined Patent Application Publication No. 2009-11179, etc.); fibers which existed at positions corresponding to the grooves 3*t* are blown and shifted to be carried onto portions corresponding to the protrusions 3*p*. In order to increase the liquid-permeability of the top sheet 3, a plurality of through holes 3*h* penetrating in the thickness direction can be provided in each of the grooves 3*t*.

—Recovering Bulkiness of Nonwoven Fabric 3—

Generally, the nonwoven fabric 3, which is used as material of the top sheet 3 of the pet pad 1, etc., after manufacture, is wound in rolls to be stored in a form of a web roll of nonwoven fabric. And in manufacturing products, the nonwoven fabric 3 is fed out from the web roll of nonwoven fabric and used. At the time of winding the nonwoven fabric 3, the nonwoven fabric 3 is subject to tension in order to prevent meandering of the nonwoven fabric 3 and in order to downside the web roll of the nonwoven fabric. Thus, the nonwoven fabric 3 wound in a roll is compressed in the thickness direction, and the bulkiness of the nonwoven fabric 3 decreases. This leads to decrease in liquid drainage, liquid return, and flexibility of the nonwoven fabric 3. In the invention, the bulkiness of the nonwoven fabric 3 is recovered by blowing hot air to heat the nonwoven fabric 3. A bulkiness recovery apparatus for the nonwoven fabric 3 will be described in detail below.

As an example of the nonwoven fabric 3 according to the invention, the nonwoven fabric 3 whose top face 3*a* has an uneven shape as shown in FIG. 1B is described. The average basis weight of the nonwoven fabric 3 shown in FIG. 1B is, for example, 10 to 200 (g/m$^2$). The average basis weight at the centers of the protrusions 3*p* is, for example, 15 to 250 (g/m$^2$), and the average basis weight at the bottoms of the grooves 3*t* is 3 to 150 (g/m$^2$). However, the invention is not limited thereto. For example, nonwoven fabric may have both surfaces which are substantially flat, and also nonwoven fabric may have both surfaces which each have an uneven shape.

A fiber constituting the nonwoven fabric 3 according to the invention is thermoplastic resin fiber. And, composite fiber having a core-sheath structure of a PET core and a PE sheath, composite fiber having a core-sheath structure of a PP core and a PE sheath, fibers having side-by-side structure, or single fiber made of one thermoplastic resin can be used for example. Also, the nonwoven fabric 3 may have crimped fiber, which is fiber having crimped shape such as zigzag shape, Ω-shape, spiral shape or the like. As the nonwoven fabric 3, nonwoven fabric having a fiber length within a range, for example, between 20 and 100 mm may be used, and also nonwoven fabric having a size, for example, within a range between 1.1 and 8.8 dtex.

First Embodiment

Figure 2:
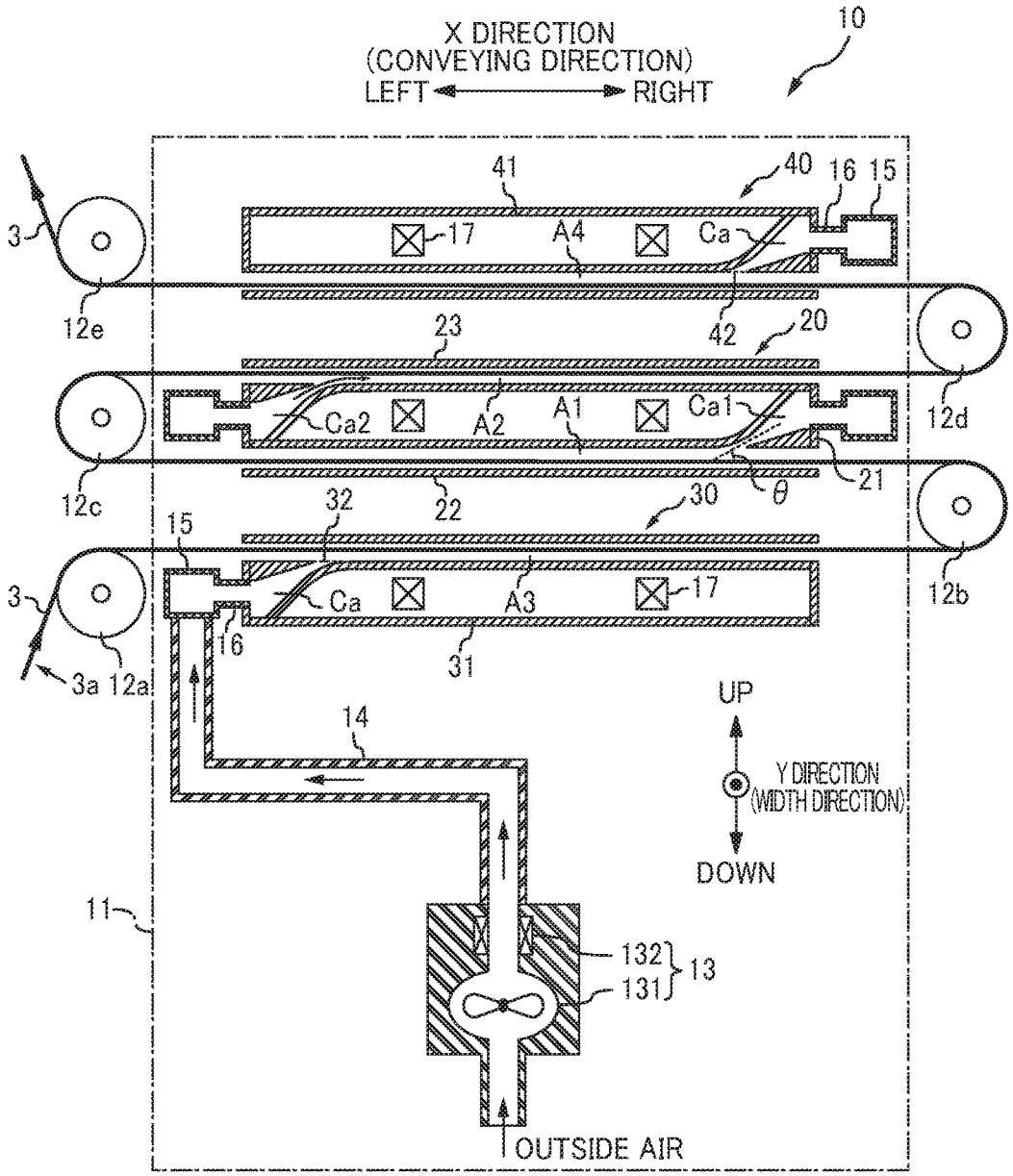
FIG. 2 is a cross sectional view of bulkiness recovery apparatus for nonwoven fabric according to the first embodiment (cross sectional view in which the width direction of the nonwoven fabric is the normal direction).
Figure 3A:
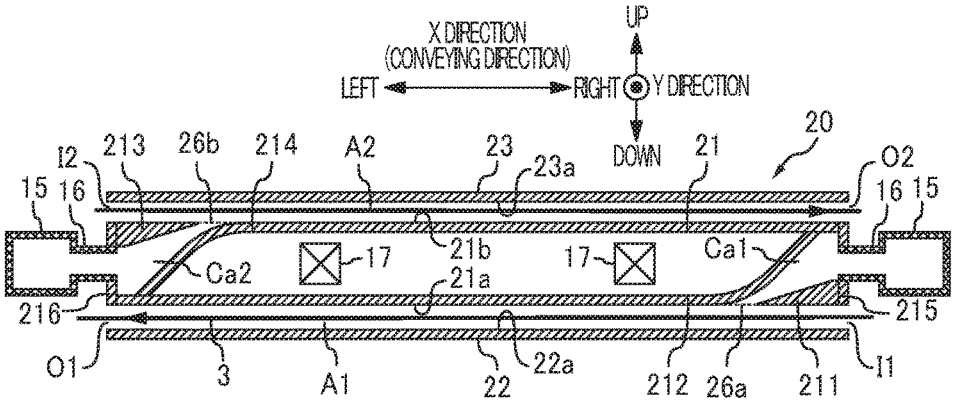
FIG. 3A is a cross sectional view of a first case unit (a cross sectional view in which the width direction of the nonwoven fabric is the normal direction)
Figure 3B:
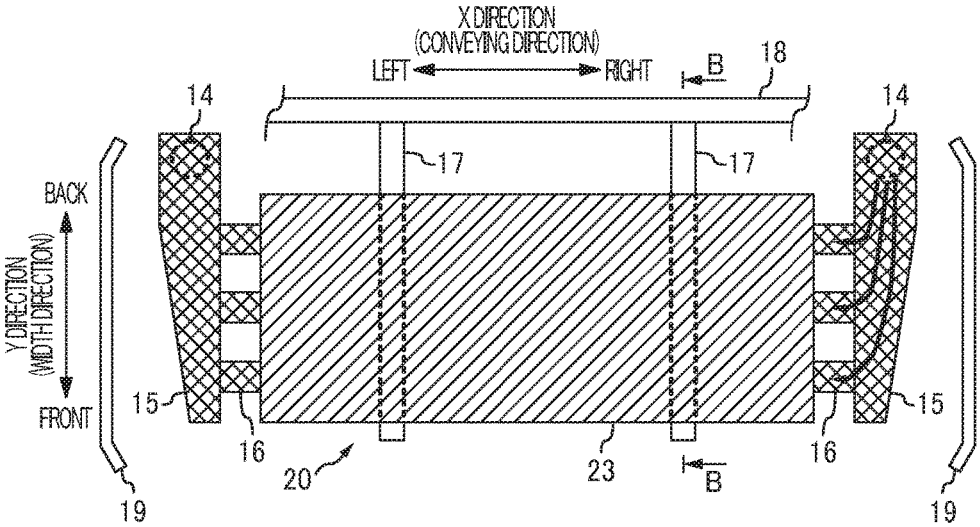
FIG. 3B is a plain view of the first case unit and its vicinity when viewed from above.
Figure 3C:
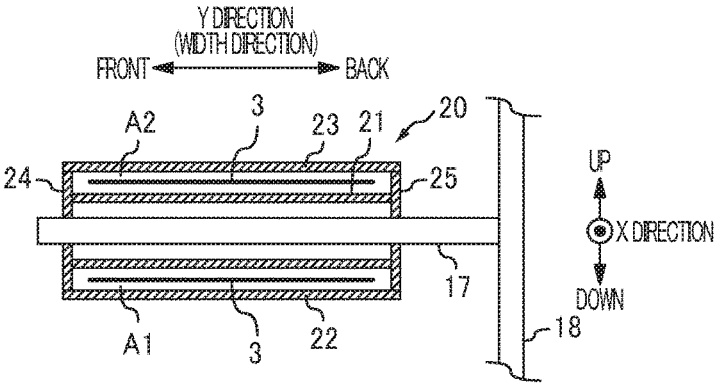
FIG. 3C is a cross sectional view of the first case unit and its vicinity taken along line B-B in FIG. 3B.
Figure 4:
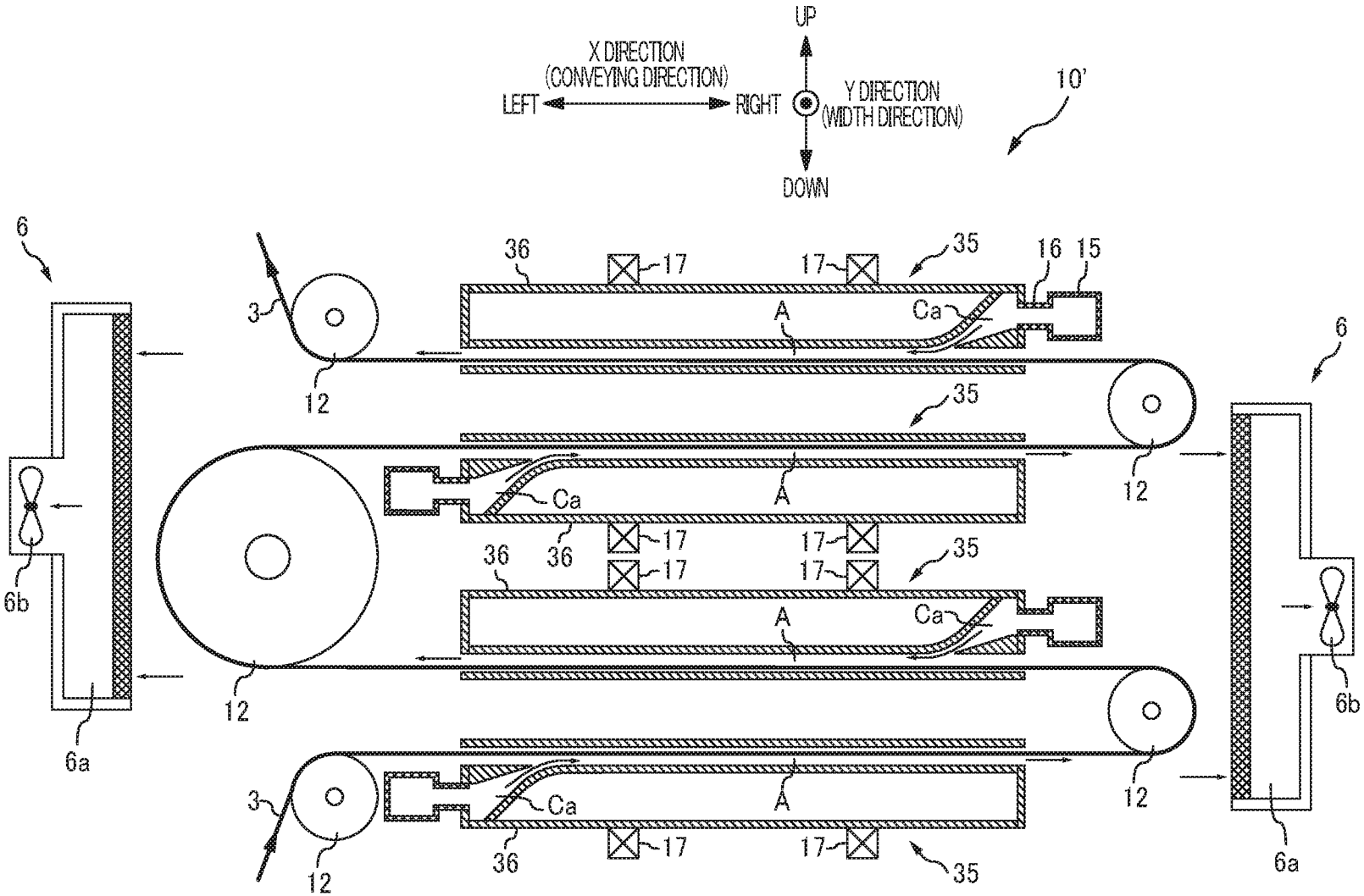
FIG. 4 is a diagram illustrating a comparative example of the bulkiness recovery apparatus for nonwoven fabric.

FIG. 2 is a cross sectional view of a bulkiness recovery apparatus 10 of the nonwoven fabric 3 according to the first embodiment (a cross sectional view in which the width direction of the nonwoven fabric 3 is the normal direction). FIG. 3A is a cross sectional view of a first case unit 20 (a cross sectional view in which the width direction of the nonwoven fabric 3 is the normal direction). FIG. 3B is a plain view of a first case unit 20 and its vicinity when viewed from above. FIG. 3C is a cross sectional view of the first case unit 20 and its vicinity taken along line B-B in FIG. 3B. FIG. 4 is a diagram illustrating a comparative example of bulkiness recovery apparatus 10' of the nonwoven fabric 3. Recovering the bulkiness of the following nonwoven fabric 3 will be described below as an example: nonwoven fabric 3 is used as the top sheet 3 of the pet pad 1 (FIG. 1B) and is continuous fabric fed out from a web roll of nonwoven fabric (not shown) wound in roll. The direction in which the grooves 3*t* and the protrusions 3*p* formed on the top face 3*a* of the nonwoven fabric 3 extend is direction in which the nonwoven fabric 3 continues. The X direction shown in the drawings corresponds to the conveying direction of the nonwoven fabric 3 in the first case unit 20 and second and third units 30 and 40. The Y direction shown in the drawings corresponds to the width direction of the nonwoven fabric 3. The direction orthogonal to the X direction and the Y direction (the direction normal to the surface of the nonwoven fabric 3) is in the up-down direction.

The bulkiness recovery apparatus 10 of the nonwoven fabric 3 according to the first embodiment includes a heating unit 11; and conveying rollers 12*a* to 12*e* conveying the nonwoven fabric 3, as shown in FIG. 2. For the sake of explanation, in an order from upstream to downstream of the conveying path of the nonwoven fabric 3, the conveying rollers are referred to as a first conveying roller 12*a*, a second conveying roller 12*b*, a third conveying roller 12*c*, a fourth conveying roller 12*d*, and a fifth conveying roller 12*e*. The heating unit 11 includes: a hot-air source 13; hot-air ducts 14; straightening chambers 15; straightening ducts 16; the first case unit 20; the second case unit 30; and the third case unit 40. The first to third case units 20 to 40 is arranged in the up-down direction, and the first case unit 20 is placed at the center in the up-down direction.

The hot-air source 13 includes a fan 131 and a heater 132. The fan 131 takes outside air and forces to the hot-air ducts 14 air which has been heated by the heater 132. It is preferable that the number of rotations of the fan 131 is changeable so that the volume of hot air is adjustable, and that the temperature of the heater 132 is changeable so that the temperature of hot air is adjustable. In this embodiment, for each of the case units 20 to 40, one hot-air source 13 is provided.

However, the invention is not limited thereto. For example, it is sufficient that a single hot-air source 13 is provided in the heating unit 11. In FIG. 2, the hot-air sources 13 and the like for the first and third case units 20 and 40 are omitted.

as shown in FIG. 3A, the first case unit 20 includes: a base member 21; a first cover member 22 (first member) provided with spacing facing the lower surface 21*a* of the base member 21 (first surface); a second cover member 23 (second member) provided with spacing facing the opposite upper surface 21*b* (second surface) to the lower surface 21*a* of the base member 21; and a pair of side plates 24 and 25 facing each other in the width direction of the nonwoven fabric 3 (see FIG. 3C). A space partitioned by the lower surface 21*a* of the base member 21, the upper surface 22*a* of the first cover member 22, and a pair of side plates 24 and 25 serves as the first conveyor space A1 of the nonwoven fabric 3. A space partitioned by the upper surface 21*b* of the base member 21, the lower surface 23*a* of second cover member 23, and a pair of side plates 24 and 25 serves as the second conveyor space A2 of the nonwoven fabric 3. the conveying direction of the nonwoven fabric 3 is different between the first conveyor space A1 and the second conveyor space A2. In the first conveyor space A1, the nonwoven fabric 3 is conveyed in the X direction (the conveying direction) from right (one side) to left (other side). In the second conveyor space A2, the nonwoven fabric 3 is conveyed in the X direction from left (other side) to right (one side). Accordingly, on the right side surface of the first case unit 20 in the X direction, there are formed an inlet I1 of the nonwoven fabric 3 to the first conveyor space A1 and an outlet O2 from the second conveyor space A2. On the left side surface of the first case unit 20 in the X direction, there are formed an outlet O1 of the nonwoven fabric 3 to the first conveyor space A1 and an inlet 12 to the second conveyor space A2.

A first jet inlet 26*a* blasts hot air to the first conveyor space A1 is formed in a right portion (a portion on the side of the inlet I1) of the lower surface 21*a* of the base member 21 in the X direction. And, a second jet inlet 26*b* blasts hot air to the second conveyor space A2 is formed in a left portion (a portion on the side of the inlet 12) of the upper surface 21*b* of the base member 21 in the X direction. It is preferable that the first and second jet inlets 26*a* and 26*b* are elongated in the Y direction to be equal to or longer than the widthwise length of the nonwoven fabric 3 so that the entire part of the nonwoven fabric 3 in the width direction is heated. A first hot-air chamber Ca1 is formed inside the base member 21 on the right side (on the side of the inlet I1) in the X direction, and the chamber Ca1 communicates with the first jet inlet 26*a* and the first conveyor space A1. Also, inside the base member 21, a second hot-air chamber Ca2 is formed on the left side (on the side of the inlet 12) in the X direction, and the chamber Ca2 communicates with the second jet inlet 26*b* and the second conveyor space A2. The first and second hot-air chambers Ca1 and Ca2 each have a nozzle shape in which a flow path of hot air gradually narrows toward the first and second jet inlets 26*a* and 26*b* respectively.

Specifically speaking, as shown in FIG. 3A, the base member 21 includes: a first lower-surface member 211 and a second lower-surface member 212 which constitute the lower surface 21*a* of the base member 21; a first upper-surface member 213 and a second upper-surface member 214 which constitute the upper surface 21*b* of the base member 21; a right side member 215 which connects the first lower-surface member 211 and the second upper-surface member 214; and a left side member 216 which connects the second lower-surface member 212 and the first upper-surface member 213. A right end part of the second lower-surface member 212 in the X direction is bent toward inside the base member 21, and a space between the first lower-surface member 211 and the bend-starting part of the second lower-surface member 212 serves as the first jet inlet 26*a*. The first hot-air chamber Ca1 is a space partitioned by the bent part of the second lower-surface member 212, the first lower-surface member 211, the second upper-surface member 214, the right side member 215 and a pair of side plates 24 and 25 (see FIG. 3C). The second hot-air chamber Ca2 has a shape obtained by reversing in the X direction and the up-down direction the first hot-air chamber Ca1.

Hot air is blasted from the first and second jet inlets 26*a* and 26*b* so that, in the first and second conveyor spaces A1 and A2, hot air flows along the conveying direction of the nonwoven fabric 3 from upstream to downstream in the conveying direction while the hot air being in contact with one surface of the nonwoven fabric 3 (the top face 3*a* in this example). For this purpose, the first and second hot-air chambers Ca1 and Ca2 each have a tapered cross section (see FIG. 3A) in which the diameter is substantially reduced toward downstream in the conveying direction, and the tip end of the tapered shape serves as each of the first and second jet inlets 26*a* and 26*b*. And, hot air is blasted toward downstream in the conveying direction at an acute angle θ to the surface of the nonwoven fabric 3. It is preferable that the angle θ between the surface of the nonwoven fabric 3 (the conveying direction) and a direction in which hot air is blasted at the positions of the jet inlets 26*a* and 26*b* is within a range from 0° to 30°. It is more preferable that the angle θ is within a range from 0° to 10°. This allows hot air to flow more reliably along the surface of the nonwoven fabric 3. This invention is not limited to blowing hot air to the top face 3*a* of the nonwoven fabric 3 (an uneven surface). Hot air may be blown to the back face 3*b* (a flat surface).

Straightening ducts 16 are connected to the right side member 215 and the left side member 216; the right side member 215 is one of members partitioning the first hot-air chamber Ca1 and is provided on the outer side in the X direction, and the left side member 216 is one of members partitioning the second hot-air chamber Ca2 and is provided on the outer side in the X direction. Each of the straightening ducts 16 is connected to the straightening chamber 15. On the other hand, as shown in FIG. 3B, the hot-air duct 14 is connected to a part of the straightening chamber 15 on the back side in the Y direction. Thus, hot air from the hot-air source 13 is supplied through the hot-air ducts 14 to the straightening chambers 15, and then hot air is supplied through the straightening ducts 16 to the first and second hot-air chambers Ca1 and Ca2. Thereafter, hot air is blasted from the first and second jet inlets 26*a* and 26*b* to the first and second conveyor spaces A1 and A2.

As mentioned above, in the first embodiment, to end surfaces of the first and second hot-air chambers Ca1 and Ca2 (side plate 25) on the back side in the Y direction, the hot-air ducts 14 are connected not directly, but via the straightening chambers 15 and the straightening ducts 16. The straightening ducts 16 are connected to end surfaces of the first and second hot-air chambers Ca1 and Ca2 (the right side member 215 and the left side member 216) on outer sides in the X direction. Accordingly, hot air can be supplied to the first and second hot-air chambers Ca1 and Ca2 while flowing hot air in the X direction (conveying direction) through the straightening ducts 16. This makes it possible to more reliably flow hot air along the conveying direction inside the first and second conveyor spaces A1 and A2. As shown in FIG. 3B, the width of each straightening chamber 15 in the X direction get smaller as it goes toward the front side in the Y direction (farther away from the side which the hot-air duct 14 is connected). This allows hot air from each hot-air duct 14 to be more smoothly supplied to the straightening duct 16 on the front side in the Y direction, and can consequently reduce an area where hot air stays in the straightening chamber 15.

Inside the base member 21, parts of the poles 17 extending in the Y direction are placed, and each pole 17 supports the first case unit 20. As shown in FIG. 3B, one end of each pole 17 is connected to a plate member 18 (a mirror plate) vertically installed on the floor of the manufacturing line, and the first case unit 20 is supported in a cantilevered manner. The number of poles 17 placed inside the base member 21 is not limited to two.

The second case unit 30 and the third case unit 40 have substantially the same configuration as the first case unit 20. However, whereas two conveyor spaces A1 and A2 are formed in the first case unit 20 and two hot-air chambers Ca1 and Ca2 are formed inside the base member 21, the second case unit 30 has a single conveyor space A3, a single jet inlet 32 and a hot-air chamber Ca. Also, the third case unit 40 has a single conveyor space A4, a single jet inlet 42 and a single hot-air chamber Ca.

Hot air which has been blasted from the jet inlets 26*a*, 26*b*, 32, 42 in the first to third case units 20 to 40 flows along the conveying direction while being in contact with the top face 3*a* of the nonwoven fabric 3. And hot air is thereafter evacuated from the outlets through which the nonwoven fabric 3 is discharged from the case units 20 to 40. Strictly speaking, parts of each of the outlets for the nonwoven fabric 3, which are on the side of the jet inlets 26*a*, 26*b*, 32, and 42 in the up-down direction with respect to the nonwoven fabric 3, serve as evacuation openings for hot air. Thus, in the first embodiment, hot air is evacuated to outside of the first to third case units 20 to 40. It is therefore preferable that, as shown in FIG. 3B, partition plates 19 are provided outside the first to third case units 20 to 40 (conveying rollers 12*a* to 12*e* not shown in FIG. 3B) in the X direction, and the partition plates 19 face the evacuation openings of hot air which is evacuated from the first to third case units 20 to 40. Thus, hot air evacuated from the first to third case units 20 to 40 can be prevented from flowing to areas of other processes, and consequently it is possible to prevent adverse effect on other processes.

In a case where the bulkiness recovery apparatus 10 having the foregoing configuration recovers the bulkiness of the nonwoven fabric 3, the nonwoven fabric 3 is first supplied to the conveyor space A3 from the left side surface of the second case unit 30 in the X direction, and the nonwoven fabric 3 is conveyed from left to right in the conveying direction (the X direction). Inside the conveyor space A3, the top face 3*a* of the nonwoven fabric 3 faces the jet inlet 32, and hot air which has been blasted from the jet inlet 32 flows toward right (downstream) along the conveying direction while being in contact with the top face 3*a* of the nonwoven fabric 3. Consequently, the nonwoven fabric 3 is heated and its bulkiness recovers. In addition, because of hot air which is blasted from the jet inlet 32, the temperature in the conveyor space A3 is higher than temperature outside the second case unit 30. Also, for this reason, the nonwoven fabric 3 is heated and its bulkiness recovers. The nonwoven fabric 3 is discharged from the second case unit 30, and its direction of motion is reversed by the second conveying roller 12*b*. And the nonwoven fabric 3 is supplied into the first conveyor space A1 of the first case unit 20.

Similarly, in the first conveyor space A1, hot air is blasted from the first jet inlet 26*a*, and the nonwoven fabric 3 is conveyed from right to left in the conveying direction. The nonwoven fabric 3 which has been discharged from the first conveyor space A1 is reversed by the third conveying roller 12*c*, and is thereafter supplied to the second conveyor space A2 of the first case unit 20. In the second conveyor space A2, hot air is blasted from the second jet inlet 26*b*, and the nonwoven fabric 3 is conveyed from left to right in the conveying direction. The nonwoven fabric 3 which has been discharged from the second conveyor space A2 is reversed by the fourth conveying roller 12*d*, and is thereafter supplied to the conveyor space A4 of the third case unit 40. In the conveyor space A4, hot air is blasted from the jet inlet 42, and the nonwoven fabric 3 is conveyed from right to left in the conveying direction. Consequently, inside the conveyor spaces A1 to A4 formed in the first to third case units 20 to 40, the nonwoven fabric 3 is heated, and the bulkiness of the nonwoven fabric 3 is recovered.

When the nonwoven fabric 3 is being conveyed inside the conveyor spaces A1 to A4, the nonwoven fabric 3 is not supported by any member. But, in order to prevent the nonwoven fabric 3 from being loosened and coming into contact with the case unit 30 to 40, tension is exerted on the nonwoven fabric 3. It is preferable that the temperature of hot air at the jet inlets 26*a*, 26*b*, 32 and 42 is set to be lower than the melting point of thermoplastic resin fiber contained in the nonwoven fabric 3 and to be equal to or higher than a temperature of 50° C. below the melting point of the thermoplastic resin fiber. This makes it possible to reliably recover the bulkiness of the nonwoven fabric 3 as well as to suppress melting of thermoplastic resin fiber.

It is preferable that the speed of hot air is larger than the speed at which the nonwoven fabric 3 is conveyed inside the conveyor spaces A1 to A4. In this case, since hot air flowing on the top face 3*a* of the nonwoven fabric 3 becomes turbulent, heat transfer efficiency improves and the nonwoven fabric 3 can be efficiently heated. In addition, the turbulent hot air loosens fibers of the nonwoven fabric 3 to facilitate bulkiness recovery. For example, it is preferable that the speed of hot air is set to be within a range from 1000 to 3000 (m/min.), and that the speed at which the nonwoven fabric 3 is conveyed is set to be within a range from 100 to 500 (m/min.). The speed of hot air (m/min.) is a value obtained by dividing the volume ($m^3$/min.) supplied to the conveyor spaces A1 to A4 by the cross section ($m^2$) of the conveyor spaces A1 to A4 taken along the up-down direction. It is preferable that the relationship between the speed of air flow and the conveying speed is established through the entire length of the conveyor spaces A1 to A4. But, even if the foregoing relationship is established in parts of the conveyor spaces A1 to A4, the effect of turbulent hot air can be achieved.

As mentioned above, in the bulkiness recovery apparatus 10 according to the first embodiment, inside the conveyor spaces A1 to A4 of the first to third case units 20 to 40, hot air flows along the conveying direction of the nonwoven fabric 3 from upstream to downstream in the conveying direction. Consequently, the nonwoven fabric 3 is heated, and the bulkiness of the nonwoven fabric 3, which has decreased by means such as winding the fabric in rolls, is recovered. Supposing that the nonwoven fabric 3 is heated by blowing hot air to a surface of the nonwoven fabric 3 in the direction normal to the surface. In this case, bulkiness recovery effect of the nonwoven fabric 3, which is achieved by heating the fabric 3, may decrease because hot air is blown to the nonwoven fabric 3 in the opposite direction to the direction in which the bulkiness of the nonwoven fabric 3 recovers (the direction in which the bulkiness is compressed). Further, the nonwoven fabric 3 may be insufficiently heated. This is because air surrounding the nonwoven fabric 3 is flowing as the nonwoven fabric 3 is conveyed and the surrounding air interrupts flowing of hot air which should be blown to the surface of the nonwoven fabric 3 the direction normal to the surface. On the other hand, in the first embodiment, hot air does not flow in the direction in which the bulkiness of the nonwoven fabric 3 decreases, but hot air flows along the conveying direction of the nonwoven fabric 3. This makes it possible to prevent decrease of bulkiness recovery effect of the nonwoven fabric 3. Also, it is possible to prevent interruption in heating the nonwoven fabric 3 caused by air which is flowing together with the nonwoven fabric 3 being conveyed.

In the bulkiness recovery apparatus 10 according to the first embodiment, the first to third case units 20 to 40 are aligned in the up-down direction, and a path in which the nonwoven fabric is being conveyed with being heated is divided. In the bulkiness recovery apparatus 10 according to the first embodiment, it is therefore possible to reduce the length of the case units 20 to 40 in the X direction while ensuring a heat time (the length of the conveying path in which heating is performed) sufficient to recover the bulkiness, compared to a bulkiness recovery apparatus, for example, whose case units are elongated, in a direction in which the nonwoven fabric 3 continues, by a length corresponding to a heat time necessary to recover the bulkiness of the nonwoven fabric 3. Consequently, it is possible to downsize the apparatus in the X direction.

The bulkiness recovery apparatus 10' of the comparative example shown in FIG. 4 will be described herein below. In the bulkiness recovery apparatus 10' of the comparative example, the number of case units 35 is greater than in the first embodiment, and four case units 35 are aligned in the up-down direction. But, the heat time of the nonwoven fabric 3 (the length of the conveying path in which heating is performed) is equal between the bulkiness recovery apparatus 10' of the comparative example and the bulkiness recovery apparatus 10 of the first embodiment. The reason is that, in the bulkiness recovery apparatus 10' of the comparative example, each case unit 35 has a single conveyor space A of the nonwoven fabric 3 and a single hot-air chamber Ca is formed inside the case unit 35 (inside the base member 36).

On the other hand, in the first case unit 20 of the bulkiness recovery apparatus 10 according to the first embodiment, two conveyor spaces A1 and A2 of the nonwoven fabric 3 are formed. Inside the common base member 21, a first hot-air chamber Ca1 and a second hot-air chamber Ca2 are formed which respectively communicate with the two conveyor spaces A1 and A2. In the up-down direction (in the direction normal to the lower surface 21*a* and the upper surface 21*b* of the base member 21), the first hot-air chamber Ca1 and the second hot-air chamber Ca2 are arranged so as to overlap. In other words, inside the base member 21, the two hot-air chambers Ca1 and Ca2 are located at the same position in the up-down direction, and the space between the lower surface 21*a* and the upper surface 21*b* of the base member 21 is as narrow as possible. Accordingly, compared to a case in which all hot-air chambers Ca are placed so as not to overlap in the up-down direction as shown in the comparative example (FIG. 4A), the bulkiness recovery apparatus 10 according to the first embodiment can be downsized in the up-down direction. Since the heat time of the nonwoven fabric 3 in the comparative example is equal to the heat time in the first embodiment as mentioned above, it can be said that the bulkiness recovery apparatus 10 according to the first embodiment can be downsized in the up-down direction while ensuring the heat time of the nonwoven fabric 3.

Compared to the comparative example, the bulkiness recovery apparatus can be downsized in the up-down direction not only if the positions of the two hot-air chambers Ca1 and Ca2 in the up-down direction are completely identical inside the base member 21, but also if positions of the two hot-air chambers Ca1 and Ca2 in the up-down direction partly overlap.

Inside the base members 21, 31 and 41 of the first to third case units 20 to 40, parts of the poles 17 which support the case units 20 to 40 are placed. More specifically, inside the base members 21, 31 and 41, the hot-air chambers Ca and parts of the poles 17 are placed so as to be at least partly overlap. Thus, placing parts of the poles 17 inside a space necessary to form the hot-air chambers Ca makes it possible to downsize the bulkiness recovery apparatus 10 in the up-down direction, compared to a case, for example, in which the poles 17 are placed outside the base member 36 like the bulkiness recovery apparatus 10' of the comparative example shown in FIG. 4. However, the invention is not limited thereto. The poles 17 may be provided outside the base members 21, 31 and 41.

The distance between the lower surface and the upper surface of each of the base members 21, 31 and 41 cannot be narrower than the distance necessary to place the hot-air chambers Ca and parts of the poles 17. But, any member is provided between the case units 20 to 40. Accordingly, in the bulkiness recovery apparatus 10 shown in FIG. 2, the diameters of the first to fifth conveying rollers 12*a* to 12*e* are identical, and therefore keep relatively wide spaces between the case units 20 to 40. But, the distance between the case units 20 to 40 may be narrowed by, for example, decreasing the diameters of the second and fourth conveying rollers 12*b* and 12*d*, compared to the diameters of the other conveying rollers 12*a*, 12*c* and 12*e*. This allows the bulkiness recovery apparatus 10 to be further downsized in the up-down direction.

In the bulkiness recovery apparatus 10' of the comparative example shown in FIG. 4, suction box 6 is provided outside the case unit 35 (conveying roller 12) in the X direction. The suction box 6 includes: a negative pressure chamber 6*a* facing the evacuation openings of hot air from the case unit 35; and a fan 6*b* provided on the bottom of the negative pressure chamber 6*a*. Driving the fan 6*b* enables hot air which has been evacuated from the case unit 35 to be sucked into the negative pressure chamber 6*a*. Providing the suction box 6 in the foregoing manner can prevent hot air from flowing to areas of other processes, and consequently it is possible to prevent adverse effect on other processes. On the other hand in the bulkiness recovery apparatus 10 according to the first embodiment, as shown in FIG. 3B, partition plates 19 alone are provided outside the case unit 20 in the X direction. Providing such partition plates 19 is sufficient to prevent hot air from flowing to areas of other processes, and consequently it is possible to prevent adverse effect on other processes. In addition, the bulkiness recovery apparatus 10 can be downsized in the X direction compared to a case in which the suction box 6 is provided.

In the bulkiness recovery apparatus 10 according to the first embodiment, the conveying rollers 12*a* to 12*e* are placed outside the first to third case units 20 to 40, and the nonwoven fabric 3 which has been heated is wound around the second to fifth conveying rollers 12*b* to 12*e* while being spontaneously cooled. This allows the nonwoven fabric 3 to be less likely to have a tendency to be curved along the outer circumferential faces of the second to fifth conveying rollers 12*b* to 12*d*, compared to a case, for example, in which the nonwoven fabric 3 is wound around the conveying rollers in a space in which hot air is blasted. In particular, in order to downsize in the X direction the bulkiness recovery apparatus 10 according to the first embodiment, the first to third case units 20 to 40 (the conveyor spaces A1 to A4) are arranged in the up-down direction. Thus, the nonwoven fabric 3 is discharged from a certain conveyor space and its direction of motion is reversed by the second to fourth conveying rollers 12*b* to 12*d*. And the nonwoven fabric 3 is supplied to the next conveyor space. If the nonwoven fabric 3 is reversed, a wound angle area of the nonwoven fabric 3 is larger compared to a case, for example, in which the direction of motion of the nonwoven fabric 3 is turned 90 degrees. Accordingly, the degree of curving of the nonwoven fabric 3 increases and is more likely to have a tendency to be curved. It is therefore preferable that the conveying rollers 12*a* to 12*e* are arranged outside the first to third case units 20 to 40.

Since the nonwoven fabric 3 is softened by heating, the nonwoven fabric 3 after being heated is more likely to stretch in the conveying direction due to tension exerted on the nonwoven fabric 3 for conveyance purpose. If the nonwoven fabric 3 stretches in the conveying direction, the width of the nonwoven fabric 3 will vary and bulkiness recovery effect will decrease. In this embodiment, inside the conveyor spaces A1 to A4 of the case units 20 to 40, hot air flows from upstream toward downstream in the conveying direction of the nonwoven fabric 3, and the direction in which hot air is flowing is in the conveying direction of the nonwoven fabric 3. This makes it possible to suppress tension exerted on the nonwoven fabric 3 for conveyance purpose, compared to a case in which the direction in which hot air is flowing is opposite the conveying direction of the nonwoven fabric 3. This makes it possible to prevent the variation in the width of the nonwoven fabric 3 and decrease of bulkiness recovery effect. Also, the nonwoven fabric 3 can be conveyed effectively. However, the invention is not limited thereto. Inside the conveyor spaces A1 to A4, hot air may flow from downstream toward upstream in the conveying direction of the nonwoven fabric 3.

The nonwoven fabric 3 may be cooled before conveying the nonwoven fabric 3 to the next process. For example, the following configuration may be employed: an apparatus having an almost same configuration as the bulkiness recovery apparatus 10 shown in FIG. 2 except for the heater 132 is provided downstream with respect to the fifth conveying roller 12*e*, and cold air whose temperature is lower than the temperature of the nonwoven fabric 3, instead of hot air, is blown to the nonwoven fabric 3 which is being conveyed inside the first to third case units 20 to 40. This makes it possible to prevent the following phenomena that will be caused by high temperature of the nonwoven fabric 3: the variation in the width of the nonwoven fabric 3 due to softening; and decrease of bulkiness recovery effect.

Second Embodiment

Figure 5:
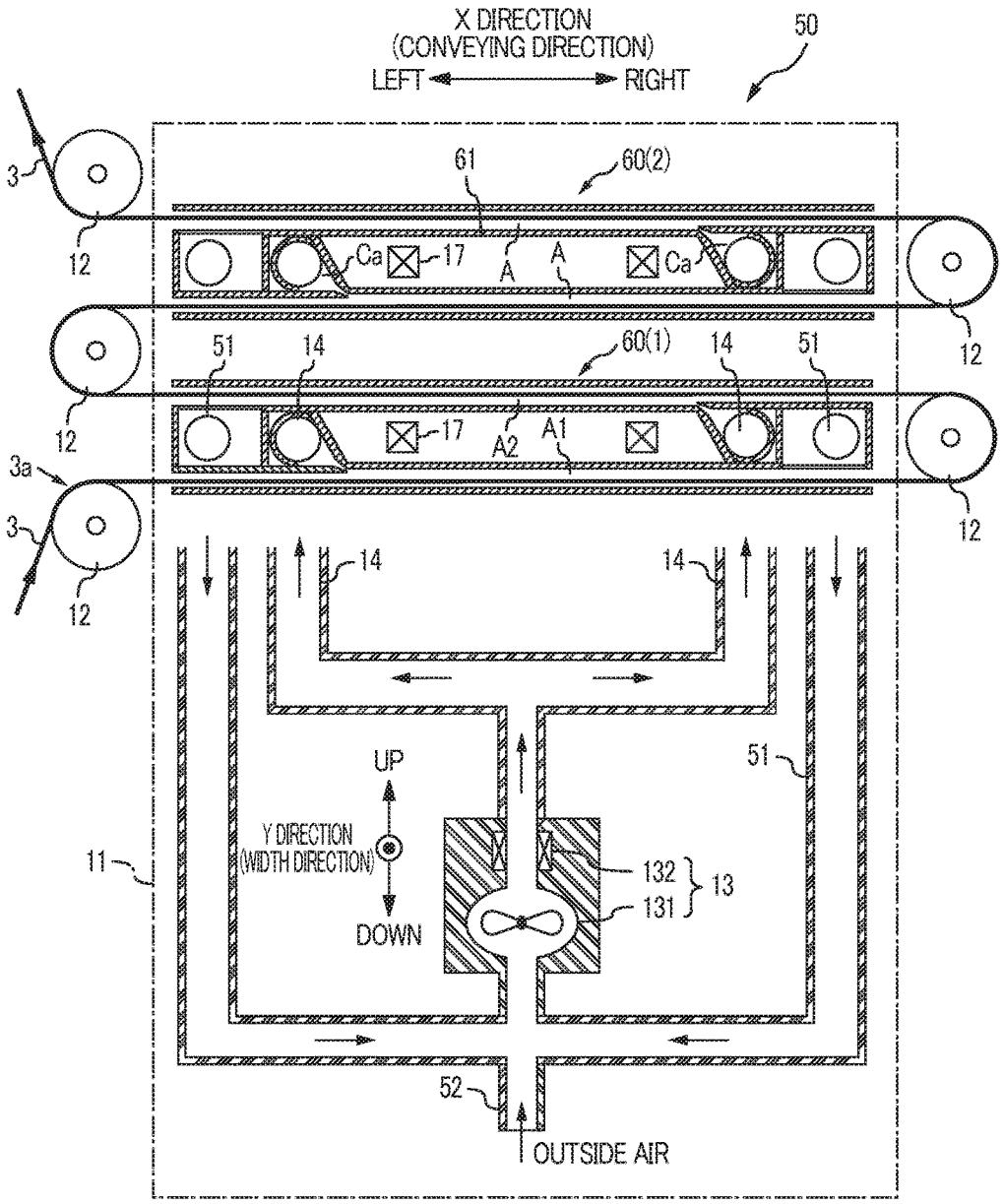
FIG. 5 is a cross sectional view of a bulkiness recovery apparatus for nonwoven fabric according to the second embodiment (a cross sectional view in which the width direction of the nonwoven fabric is the normal direction).
Figure 6A:
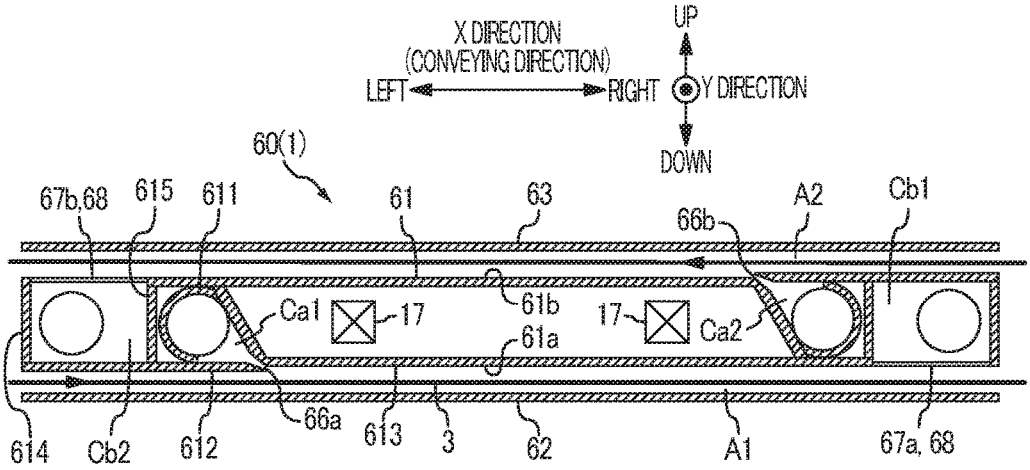
FIG. 6A is a cross sectional view of a first case unit (a cross sectional view in which the width direction of the nonwoven fabric is the normal direction)
Figure 6B:
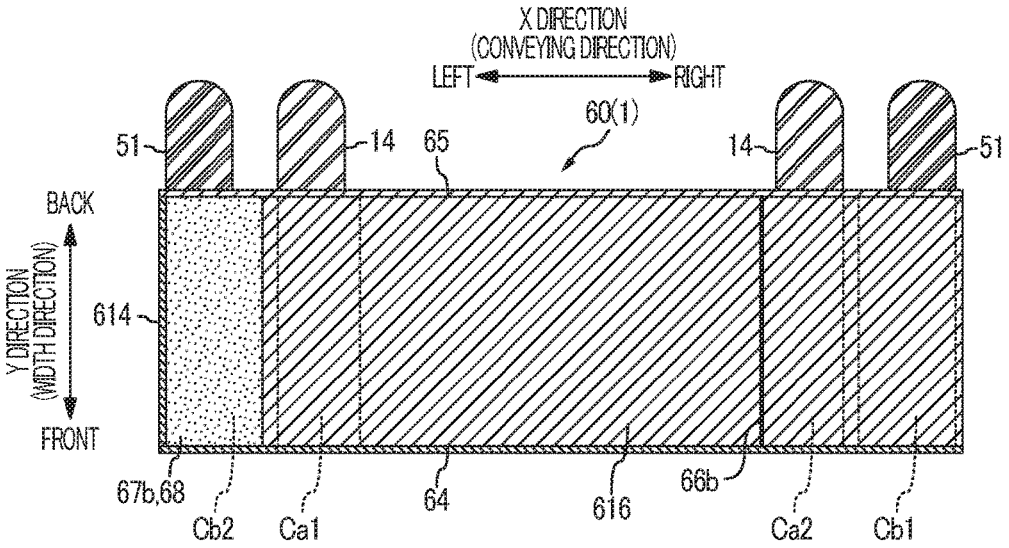
FIG. 6B is a plain view of the first case unit and its vicinity when viewed from above, a second cover member of the first case unit being removed.

FIG. 5 is a cross sectional view of a bulkiness recovery apparatus 50 of the nonwoven fabric 3 according to the second embodiment (a cross sectional view in which the width direction of the nonwoven fabric 3 is the normal direction). FIG. 6A is a cross sectional view of a first case unit 60(1) (a cross sectional view in which the width direction of the nonwoven fabric 3 is the normal direction) FIG. 6B is a plain view of the first case unit 60(1) and its vicinity when viewed from above, a second cover member 63 of the first case unit 60(1) being removed. The bulkiness recovery apparatus 50 of the nonwoven fabric 3 according to the second embodiment includes the heating unit 11 and conveying rollers 12. The heating unit 11 includes: the hot-air source 13; the hot-air ducts 14; circulating ducts 51; the first case unit 60(1); and a second case unit 60(2). The first and second case units 60(1) and 60(2) are arranged in the up-down direction, and the first case unit 60(1) is located below the second case unit 60(2).

As shown in FIG. 6A, the first case unit 60(1) includes: the base member 61; a first cover member 62 (first member); a second cover member 63 (second member); and a pair of side plates 64 and 65 facing each other in the width direction of the nonwoven fabric 3 (see FIG. 6B). Inside the first case unit 60(1), the first conveyor space A1 and the second conveyor space A2 are formed; in the first conveyor space A1, the nonwoven fabric 3 is conveyed from left to right in the X direction, and in the second conveyor space A2, the nonwoven fabric 3 is conveyed from right to left in the X direction. A first jet inlet 66*a* blasts hot air is formed in a left portion of the lower surface 61*a* of the base member 61 (the first surface) in the X direction, and a second jet inlet 66*b* blasts hot air is formed in a right portion of the upper surface 61*b* of the base member 61 (the second surface) in the X direction. And, the nonwoven fabric 3 is heated in the first and second conveyor spaces A1 and A2 and its bulkiness recovers.

As in the first embodiment, the first hot-air chamber Ca1 and the second hot-air chamber Ca2 are formed inside the base member 61, and these first and second hot-air chambers Ca1 and Ca2 are placed so as to overlap in the up-down direction. In addition, a space between the lower surface 61*a* and the upper surface 61*b* of the base member 61 is as small as possible. Accordingly, the bulkiness recovery apparatus 50 according to the second embodiment can be downsized in the up-down direction, compared to the bulkiness recovery apparatus 10' of the comparative example (FIG. 4).

In the second embodiment, the second case unit 60(2) has the same configuration as the first case unit 60(1). Accordingly, whereas the three case units 20 to 40 are aligned in the up-down direction in the first embodiment, two case units 60(1) and 60(2) are aligned in the up-down direction in the second embodiment. But, the heat time of the nonwoven fabric 3 (the length of the conveying path in which heating is performed) can be the same as in the first embodiment. That is, two hot-air chambers Ca1 and Ca2 which are located at the same position in the up-down direction inside the base member 61 are formed in each of a plurality of the case units 60(1) and 60(2), and the plurality of case units 60(1) and 60(2) are aligned in the up-down direction (in the direction normal to the lower surface 61*a* and the upper surface 61*b* of the base member 61). This makes it possible to further downsize the bulkiness recovery apparatus 50 in the up-down direction. The first and second case units 60(1) and 60(2) may be aligned in a direction tilted to the up-down direction.

In the second embodiment, as shown in FIG. 6B, the hot-air ducts 14 that supply hot air from the hot-air source 13 are connected to one surface of surfaces partitioning the first and second hot-air chambers Ca1 and Ca2, the surface being a side surface in the width direction of the nonwoven fabric 3 (in this example, the side plate 65 on the back side in the Y direction). Accordingly, the bulkiness recovery apparatus 50 according to the second embodiment can be downsized in the conveying direction (the X direction) by volumes corresponding to the straightening chamber 15 and the straightening duct 16, compared to a case in which the straightening ducts 16 are connected to one surface of surfaces partitioning the first and second hot-air chambers Ca1 and Ca2, the surface being an end surface on an outer end in the conveying direction of the nonwoven fabric 3 as in the first embodiment (FIG. 3A).

In the second embodiment, the hot-air chamber Ca1 is partitioned by a curved member 611 provided along the end opening of the hot-air duct 14. This allows hot air from the hot-air duct 14 to smoothly flow the jet inlet 66*a*, and can consequently reduce an area where hot air stays in the hot-air chamber Ca1. In the second embodiment, of the first and second lower-surface members 612 and 613 which constitute the lower surface 61*a* of the base member 61, the first lower-surface member 612 located upstream in the conveying direction is arranged closer to the conveyor space A1 in the up-down direction with respect to the second lower-surface member 613 located downstream in the conveying direction. This allows hot air to flow more reliably along the conveying direction of the nonwoven fabric 3.

In the second embodiment, hot air which has been blasted from the first and second jet inlets 66*a* and 66*b* is reclaimed and circulated. Accordingly, a first evacuation opening 67*a* is formed on the right side (the side of the outlet for the nonwoven fabric 3) of the lower surface 61*a* of the base member 61 in the X direction, and hot air is blasted from the first jet inlet 66*a*, flows along the conveying direction, and is evacuated by the first evacuation opening 67*a* from the first conveyor space A1. Similarly, a second evacuation opening 67*b* is formed on the left side (the side of the outlet for the nonwoven fabric 3) of the upper surface 61*b* of the base member 61 in the X direction, and hot air is blasted from the second jet inlet 66*b*, flows along the conveying direction, and is evacuated by the second evacuation opening 67*b* from the second conveyor space A2.

Inside the base member 61, a first evacuation chamber Cb1 is formed on the right side in the X direction, and the chamber Cb1 communicates with the first evacuation opening 67*a* and the first conveyor space A1. Also, a second evacuation chamber Cb2 is formed on the left side in the X direction, and the chamber Cb2 communicates with the second evacuation opening 67*b* and the second conveyor space A2. Specifically speaking, for example, the second evacuation chamber Cb2 is partitioned by the first lower-surface member 612, a left side member 614 of the base member 61 in the X direction, a member 615 facing the member 614, and the side plates 64 and 65. In addition, the first evacuation chamber Cb1 and the second evacuation chamber Cb2 are arranged inside base member 61 so as to overlap in the up-down direction. And, the first and second evacuation chambers Cb1 and Cb2 are arranged so as to overlap, in the up-down direction, on the first and second hot-air chambers Ca1 and Ca2. In other words, concerning the first evacuation chamber Cb1, the second evacuation chamber Cb2, the first hot-air chamber Ca1, and the second hot-air chamber Ca2, their positions in the up-down direction are identical. Accordingly, the bulkiness recovery apparatus 50 can be downsized in the up-down direction, compared to cases, for example, in which the first and second evacuation chambers Cb1 and Cb2 are arranged so as not to overlap in the up-down direction, or in which the first and second evacuation chambers Cb1 and Cb2 are arranged so as not to overlap, in the up-down direction, on the first and second hot-air chambers Ca1 and Ca2.

It is sufficient that the first and second evacuation chambers Cb1 and Cb2 overlap partly in the up-down direction. And it is sufficient that the first and second evacuation chambers Cb1 and Cb2 and the first and second hot-air chambers Ca1 and Ca2 overlap partly in the up-down direction. In these cases, the bulkiness recovery apparatus 50 can be downsized in the up-down direction. Since the second case unit 60(2) has the same configuration as the first case unit 60(1), the bulkiness recovery apparatus 50 can be further downsized in the up-down direction.

As shown in FIG. 6B, the circulating ducts 51 are connected to one surface of surfaces partitioning the first and second evacuation chambers Cb1 and Cb2, the surface being a side surface in the width direction of the nonwoven fabric 3 (in this example, the side plate 65 on the back side in the Y direction). Accordingly, the bulkiness recovery apparatus 50 can be downsized in the X direction, compared to a case, for example, in which the circulating ducts 51 are connected to one surface of surfaces partitioning the first and second evacuation chambers Cb1 and Cb2, the surface being an end surface on an outer end in the conveying direction of the nonwoven fabric 3.

As shown in FIG. 5, the circulating ducts 51, which are connected to the first and second evacuation chambers Cb1 and Cb2, is connected to an intake duct 52 of the hot-air generator 13. Accordingly, hot air that has been blasted from the first and second jet inlets 66*a* and 66*b* flows along the conveying direction of the nonwoven fabric 3, and the air is reclaimed from the first and second evacuation chambers Cb1 and Cb2 to the circulating ducts 51, and is subsequently reheated by the heater 132 of the hot-air generator 13. Then, hot air is forced from the hot-air duct 14 to the conveyor spaces A1 and A2.

Thus, circulating hot air which heats the nonwoven fabric 3 can increase the efficiency of heating hot air by the heater 132. The volume of hot air which is evacuated outside the case units 60(1) and 60(2) decreases. This can prevent hot air from flowing to areas of other processes, and consequently it is possible to prevent adverse effect on other processes. In addition, the temperature outside the case units 60(1) and 60(2) can be lowered, and this makes it possible to wind around the conveying roller 12 the nonwoven fabric 3 which has been further cooled spontaneously. This allows the nonwoven fabric 3 to be less likely to have a tendency to be curved. Providing the first and second the evacuation chambers Cb1 and Cb2 inside the base member 61 as in the second embodiment allows the bulkiness recovery apparatus 50 to be downsized in the X direction, compared to a case in which the suction box 6 is provided outside the case unit 35 like the comparative example (FIG. 4) to prevent hot air from flowing to areas of other processes.

A filter 68 which let hot air pass but stop foreign matter may be provided in the first and second evacuation openings 67*a* and 67*b*. This makes it possible to prevent foreign matter (fiber waste of the nonwoven fabric 3, etc.) from circulating together with hot air. It is preferable that the filter 68 is provided inside the base member 61 instead of being provided in the lower surface 61*a* of the base member 61 or in the upper surface 61*b* of the same. This makes it possible to reduce the lengths of the case units 60(1) and 60(2) in the up-down direction, compared to a case, for example, in which filter 68 is provided projected towards the conveyor spaces A1 and A2 beyond the lower surface 61*a* or the upper surface 61*b* of the base member 61. Consequently, the bulkiness recovery apparatus 50 can be downsized in the up-down direction.

On the left side inside the base member 61 in the X direction (conveying direction), the second evacuation chamber Cb2 is placed left with respect to the first hot-air chamber Ca1. On right side inside the base member 61 in the X direction, the first evacuation chamber Cb1 is placed right with respect to the second hot-air chamber Ca2. In other words, the first and second evacuation chambers Cb1 and Cb2 are placed closer to an end of the base member 61 in the X direction with respect to the first and second hot-air chambers Ca1 and Ca2. Accordingly, the distance hot air flows in the conveying direction inside the conveyor spaces A1 and A2 is not too long, and that is, the distance the top face 3*a* of the nonwoven fabric 3 will travel being exposed to hot air is not excessively long. Consequently, it is possible to prevent overheating the nonwoven fabric 3. This makes it possible to wind around the conveying roller 12 the nonwoven fabric 3 which has been further cooled spontaneously. This allows the nonwoven fabric 3 to be less likely to have a tendency to be curved. This makes it possible to prevent the following phenomena that will be caused by high temperature of the nonwoven fabric 3: the variation in the width of the nonwoven fabric 3 due to softening; and decrease of bulkiness recovery effect.

Third Embodiment

Figure 7:
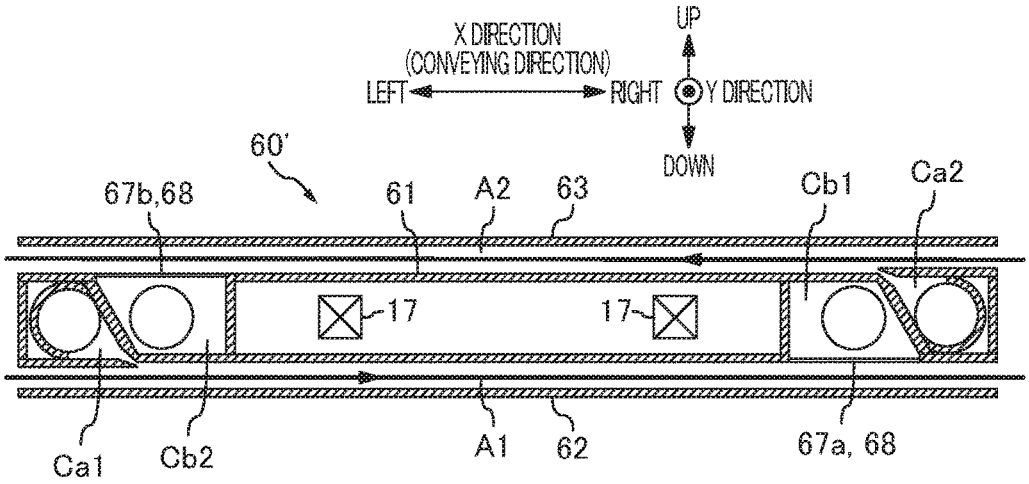
FIG. 7 is a cross sectional view of a case unit according to the third embodiment (a cross sectional view in which the width direction of the nonwoven fabric is the normal direction).

FIG. 7 is a cross sectional view of a case unit 60' according to the third embodiment (a cross sectional view in which the width direction of the nonwoven fabric 3 is the normal direction). Though the case unit 60' according to the third embodiment has substantially the same configuration as the case unit 60(1) of the second embodiment shown in FIG. 6A, the arrangement of the hot-air chambers Ca1 and Ca2 and the evacuation chambers Cb1 and Cb2 are reversed. That is, in the third embodiment, on the left side inside the base member 61 in the X direction (conveying direction), the first hot-air chamber Ca1 is placed left with respect to the second evacuation chamber Cb2. On right side inside the base member 61 in the X direction, the second hot-air chamber Ca2 is placed right with respect to the first evacuation chamber Cb1. In other words, the first and second hot-air chambers Ca1 and Ca2 are placed closer to an end of the base member 61 in the X direction with respect to the first and second evacuation chambers Cb1 and Cb2. Accordingly, the distance hot air flows in the conveying direction inside the conveyor spaces A1 and A2 becomes longer, and that is, the distance the top face 3*a* of the nonwoven fabric 3 will travel being exposed to hot air becomes longer. This makes it possible to more reliably heat the nonwoven fabric 3 to recover its bulkiness. In other words, it is possible to reduce the length of the case unit 60' in the X direction while ensuring the heat time of the nonwoven fabric 3 (the length of the conveying path in which heating is performed) necessary to recover the bulkiness. Consequently, the bulkiness recovery apparatus can be downsized in the X direction.

Other Embodiments

While the embodiments of the invention are described above, the embodiments are for the purpose of elucidating the understanding of the invention and are not to be interpreted as limiting the invention. The invention can of course be altered and improved without departing from the gist thereof, and equivalents are intended to be embraced therein.

In the foregoing embodiments, the apparatus installed in horizontal orientation is described as an example, in which the conveying direction of the nonwoven fabric 3 in the case units is along the X direction (the horizontal direction). However, the invention is not limited thereto. For example, an apparatus installed in vertical orientation may be employed in which the conveying direction of nonwoven fabric in case units is along the up-down direction. In the foregoing embodiments, the bulkiness recovery apparatus includes two or three case units. However, the invention is not limited thereto. The bulkiness recovery apparatus may include a single case unit or may include four or more case units.

In the foregoing embodiments, the bulkiness of the nonwoven fabric 3 which is used as the top sheet 3 of the pet pad 1 (FIG. 1B) is recovered as an example. However, the invention is not limited thereto. For example, the invention is effective in recovering the bulkiness of nonwoven fabric which is used for an absorbent article such as sanitary napkin or disposable diaper or is used as a cleaning sheet, etc. attached to a cleaning mop. Further, in the foregoing embodiments, the bulkiness of continuous nonwoven fabric 3 wound in a roll is recovered as an example. However, the invention is not limited thereto. For example, the invention is also effective in recovering the bulkiness of nonwoven fabric which is cut to a certain length. This is because there is a possibility that the bulkiness of nonwoven fabric which has been cut to a certain length decreases if the nonwoven fabric is stored in a stacked manner.

In the foregoing embodiment, though hot air (flowing heated air) is blown to the nonwoven fabric to heat the nonwoven fabric, such air flow includes in the wider sense flow of gas such as nitrogen gas and inert gases. Accordingly, the nonwoven fabric 3 may be heated by blowing, for example, nitrogen gas to the nonwoven fabric 3.

REFERENCE SIGNS LIST

1 pet pad, 3 top sheet (nonwoven fabric), 3*t* groove, 3*p* protrusion,
3*h* through hole, 4 absorbent body, 4*c* absorbent core, 4*t* cover sheet, 5 back sheet,
10 bulkiness recovery apparatus, 11 heating unit, 12*a* to 12*e* conveying roller,
13 hot-air source, 131 fan, 132 heater, 14 hot-air duct (duct), straightening chamber, 16 straightening duct, 17 pole, 18 plate member,
19 partition plate, 20 first case unit, 21 base member,
22 first cover member (first member), 23 second cover member (second member),
24 side plate, 25 side plate, 26*a* first jet inlet,
26*b* second jet inlet, 30 second case unit, 40 third case unit,
A1 first conveyor space, A2 second conveyor space,
Ca1 first hot-air chamber, Ca2 second hot-air chamber,
50 bulkiness recovery apparatus, 51 circulating duct (duct), 60(1) first case unit,
60(2) second case unit, 61 base member, 62 first cover member (first member),
63 second cover member (second member), 64 side plate, 65 side plate, 66*a* first jet inlet,
66*b* second jet inlet, 67*a* first evacuation opening, 67*b* second evacuation opening,
68 filter, Cb1 first evacuation chamber, Cb2 second evacuation chamber,

The invention claimed is:

1. A bulkiness recovery apparatus for nonwoven fabric, the apparatus being for recovering bulkiness of the nonwoven fabric by blowing hot air to heat the nonwoven fabric, the apparatus comprising:
a hot-air source; and
a case unit including a base member, a first member and a second member,
the first member being provided facing a first surface of the base member and partitioning a first conveyor space for the nonwoven fabric,
the second member being provided facing a second surface of the base member and partitioning a second conveyor space for the nonwoven fabric,
the base member having a first hot-air chamber and a second hot-air chamber formed inside the base member,
the first surface having a first jet inlet,
the second surface being placed on a side opposite the first surface,
the second surface having a second jet inlet,
the first hot-air chamber being supplied with hot air from the hot-air source and communicating with the first jet inlet,
the second hot-air chamber being supplied with hot air from the hot-air source and communicating with the second jet inlet,
the first hot-air chamber and the second hot-air chamber being arranged so as to at least partly overlap in a direction normal to the first surface,
a conveying direction in which the nonwoven fabric is conveyed inside the first conveyor space being different from the conveying direction in the second conveyor space,
hot air being blasted from the first jet inlet into the first conveyor space,
the hot air flowing along the conveying direction from a one side toward another side in the conveying direction inside the first conveyor space,
hot air being blasted from the second jet inlet into the second conveyor space,
the hot air flowing along the conveying direction from the other side toward the one side in the conveying direction inside the second conveyor space.

2. A bulkiness recovery apparatus for nonwoven fabric according to claim 1, wherein
a part of a pole that supports the case unit is placed inside the base member.

3. A bulkiness recovery apparatus for nonwoven fabric according to claim 1, wherein
a first evacuation opening is formed in the first surface,
hot air is blasted from the first jet inlet, flows along the conveying direction, and is evacuated through the first evacuation opening from the first conveyor space,
a second evacuation opening is formed in the second surface,
hot air is blasted from the second jet inlet, flows along the conveying direction, and is evacuated through the second evacuation opening from the second conveyor space,
a first evacuation chamber and a second evacuation chamber are formed inside the base member,
the first evacuation chamber communicates with the first evacuation opening,
the second evacuation chamber communicates with the second evacuation opening,
the first evacuation chamber, the second evacuation chamber, the first hot-air chamber, and the second hot-air chamber are placed so as to at least partly overlap in the direction normal to the first surface.

4. A bulkiness recovery apparatus for nonwoven fabric according to claim 3, wherein
on the one side inside the base member in the conveying direction,
the second evacuation chamber is placed outside on the one side with respect to the first hot-air chamber, and on the other side inside the base member in the conveying direction, the first evacuation chamber is placed outside on the other side with respect to the second hot-air chamber.

5. A bulkiness recovery apparatus for nonwoven fabric according to claim 3, wherein on the one side inside the base member in the conveying direction, the first hot-air chamber is placed outside on the one side with respect to the second evacuation chamber, and on the other side inside the base member in the conveying direction, the second hot-air chamber is placed outside on the other side with respect to the first evacuation chamber.

6. A bulkiness recovery apparatus for nonwoven fabric according to claim 3, wherein a duct that evacuates hot air from the case unit is connected to one surface of surfaces partitioning the first evacuation chamber, the surface being a side surface in a width direction of the nonwoven fabric and intersecting the conveying direction, and the duct is also connected to one surface of surfaces partitioning the second evacuation chamber, the surface being a side surface in the width direction.

7. A bulkiness recovery apparatus for nonwoven fabric according to claim 1, wherein a duct that supplies hot air from the hot-air source is connected to one surface of surfaces partitioning the first hot-air chamber, the surface being a side surface in a width direction of the nonwoven fabric and intersecting the conveying direction, and the duct is also connected to one surface of surfaces partitioning the second hot-air chamber, the surface being a side surface in the width direction.

8. A bulkiness recovery apparatus for nonwoven fabric according to claim 1, wherein a plurality of the case units are aligned in a direction intersecting the first surface.

* * * * *